United States Patent [19]

Costa

[11] 3,972,487

[45] Aug. 3, 1976

[54] LOADING DEVICE FOR REELS OF PAPER TAPE

[75] Inventor: Armando Costa, Ivrea (Turin), Italy

[73] Assignee: Ing. C. Olivetti & C., S.p.A., Ivrea (Turin), Italy

[22] Filed: June 11, 1975

[21] Appl. No.: 586,001

[30] Foreign Application Priority Data

Aug. 27, 1974 Italy ..... 69614/74

[52] U.S. Cl. ..... 242/68.7; 242/66; 242/78.7

[51] Int. Cl.² ..... B65H 75/12

[58] Field of Search ..... 242/68.7, 78.7, 55.53, 242/66; 221/66, 17, 18; 312/DIG. 17

[56] References Cited

UNITED STATES PATENTS

| | | | |
|---|---|---|---|
| 2,260,643 | 10/1941 | Rosan | 221/18 |
| 3,406,925 | 10/1968 | Waterhouse | 242/78.7 X |
| 3,472,463 | 10/1969 | Fedor | 242/78.7 |
| 3,809,287 | 5/1974 | Scherak | 221/66 |
| 3,833,146 | 9/1974 | Braginetz | 221/66 |

*Primary Examiner*—Edward J. McCarthy
*Attorney, Agent, or Firm*—I. J. Schaefer

[57] ABSTRACT

A loading device for reels of paper tape wound on a central spool is provided with an automatic device for ejecting the empty spools, by introducing a new full reel.

7 Claims, 1 Drawing Figure

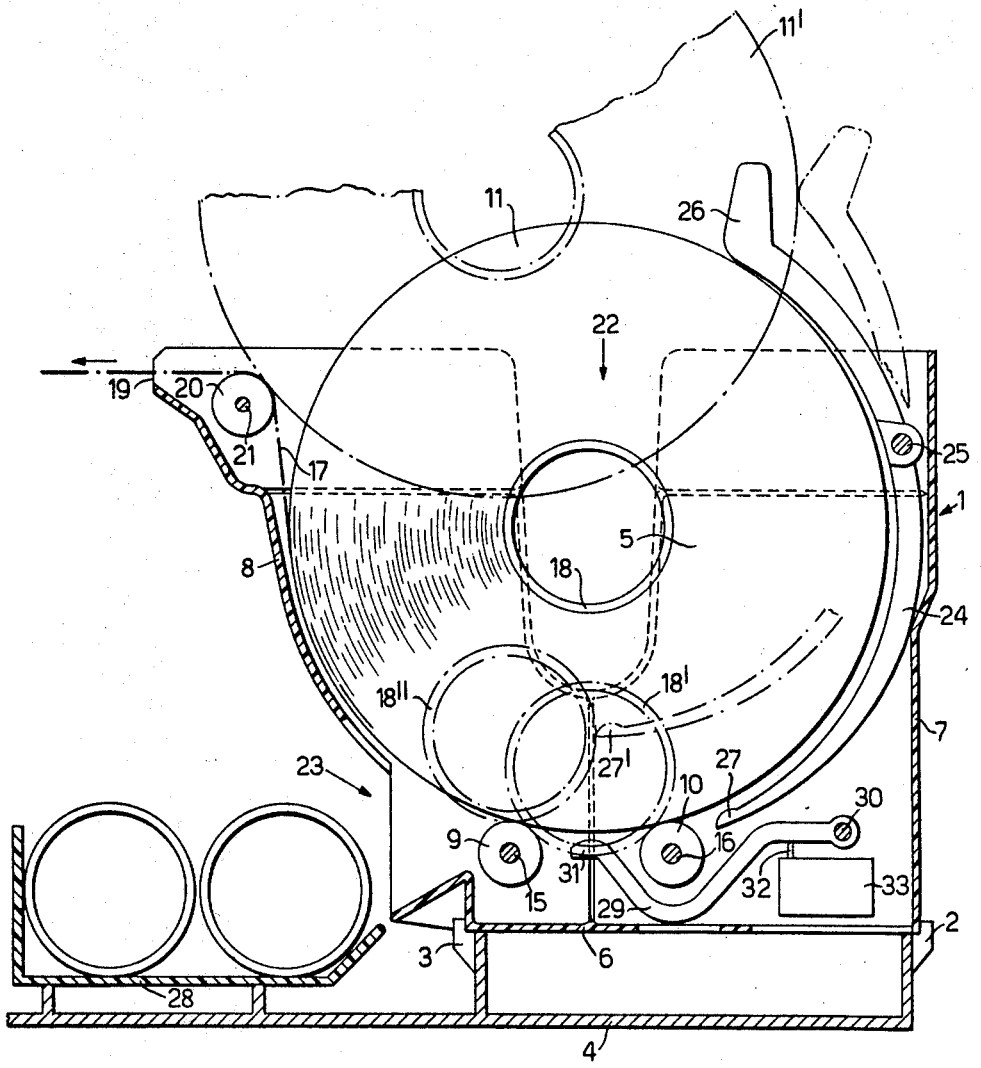
11'
11
26
22
19
20
21
17
25
1
5
8
18
24
18''
18'
7
27'
27
23
10
30
9
16
31'
15
32
33
29
2
3
6
28
4

LOADING DEVICE FOR REELS OF PAPER TAPE

BACKGROUND OF THE INVENTION

Field of the Invention

The present invention refers to a loading device for reels of paper tape and more particularly to a loading device for reels of paper tape wound on a central spool with a device for automatic ejection of the central spool.

In a well-known type of reel container, the reel rests by force of gravity on two parallel rollers which enable the unwinding of the reel but when the reel has been completely unwound, the central spool must be removed manually to make room for the new full reel. This type of container is not practical as a manual operation is required to remove the empty central spool.

SUMMARY OF THE INVENTION

The reel loader, may be used together with equipment for the punching of paper tapes and includes a container with an upper opening into which the above-mentioned reels are inserted one at a time, support means for supporting the above-mentioned reels, a lower opening and means operated by the reel being introduced which makes it possible to pass from a first rest position to a second ejection position to remove said spool through said opening.

Accordingly, it is an object of the present invention to provide an improved loading device for reels of paper tape.

Another object of the present invention is to provide a loading device for reels of paper tape as described above, having improved means for automatically ejecting the central spool of a completely unwound preceding reel.

These and other objects, features and advantages of the invention will, in part, be pointed out with particularity, and will, in part, become obvious from following more detailed description of the invention taken in conjunction with the accompanying drawing, which form an integral part thereof, and which represents a vertical cross section of the reel loading device according to the invention.

BRIEF DESCRIPTION OF THE DRAWINGS:

The FIGURE shows a vertical section of the reel container according to the invention.

DESCRIPTION OF THE PREFERRED EMBODIMENT

Referring now to the attached drawing, a container 1 of substantially parallelepiped shape open at the top consists of two lateral walls of which only the lefthand one 5 is shown in the attached diagram, connected together by a base 6 by a rear wall 7 and a front part 8. The container 1 rests on projections 2 and 3 and a base 4. Two rollers 9 and 10 which rotate around two pins 15 and 16, fixed to the lateral walls of the container 1 are used to support a reel 11 consisting of a roll of paper tape 17 wound around a cylindrical central spool 18. Reel 11 may rotate on rollers 9 and 10 when the paper tape is pulled, to unroll it for example, in the direction of the arrow.

Before leaving the container 1 through opening 19, the paper tape 17 is partially wound round a roller 20 which rotates around a pin 21 fixed to the lateral sides of container 1.

The lateral sides of the container 1 are provided with an opening 22 coinciding to spool 18 which makes it possible to raise the reel 11 when this is to be removed before it is empty, grasping it by the central spool 18 thus avoiding any damage to the edges of the tape which has already been wound.

The front of the container 8 is provided with a lower opening 23 which makes it possible to extract the empty spool when an empty reel is being replaced with a full one in the manner described below.

A lever 24 of substantially arched shape is pivotally connected with a pin 25 fixed to the lateral sides of the container 1 and which has an upper tongue 26. The lever 24 is normally at rest as indicated in the drawing by the solid line and may be rotated in a clockwise direction until it is in the ejection position indicated by the dotted line in the drawing.

As the tape unwinds from reel 11, its diameter decreases and spool 18 moves downwards until in position 18' indicated by the dotted line when the spool is empty.

When a new reel 11' with a wider diameter than the distance between the roller 20 and the tongue 26 of the lever 24 is in the at rest position, the latter is rotated clockwise so that the new reel can be inserted. At the same time, the lower edge 27 of the lever 24, moving into position 27' moves the spool from position 18' forcing it to pass over the roller 9, into position 18''. Once position 27' has been exceeded, the edge 27 of the lever 24 causes the spool 18 to drop by weight through the lower opening 23 into a removable drawer for the collection of the empty spools.

Subsequently, while the new reel drops to rest on rollers 9 and 10, the lever 24 is rotated by the reel itself in an anti-clockwise direction returning to the at rest position.

The container is further provided with a tape out indicator. This consists of a lever 29 pivotally connected at one end with a pin 30. The other end 31 of the lever 29 is placed between the rollers 9 and 10 in such a way that it is pressed down by the reel which is almost finished. In fact, at this point, the diameter of the reel is very small, almost the same as that of the spool and therefore penetrates between the rollers 9 and 10 much more than when the reel is full.

The lever 29 acts on the bar 32 of a micro-switch 33 which generates a warning signal that the spool is almost empty.

However, it is to be understood that various charges and modifications and additions may be made to the above descripted device without departing from the spirit of the invention.

What we claim is:

1. A loading device for reels of paper tape wound on a central spool comprising:

a container provided with an opening at the bottom portion thereof and an upper opening receptive of reels of paper tape, introduced one at a time into said container through said upper opening, support means for supporting said reels, and ejection means movable in said container and engageable with said reel which is successively inserted to effect the movement of said ejection means from a rest position to an ejection position in order to eject through said bottom opening said central spool of the preceding reel, now completely unwound.

2. A loading device as in claim 1, wherein said ejection means include an arched lever pivotally connected within said container, having a lower end engageable with said spool in said ejection position and an upper edge which engages with said reel when it is inserted.

3. A loading device for reels of paper tape wound on a central spool comprising:

a container having an opening at the bottom portion thereof and an opening at the top portion thereof and receptive through the top opening of reels of paper tape loaded one at a time;

means for mounting a loaded paper tape in the container for free rotational movement; and automatic spool ejecting means for ejecting the empty spool of a previously loaded tape through the bottom opening when another wound paper tape is loaded in the container through the top opening.

4. A device according to claim 3, wherein said ejecting means comprises lever means pivotally mounted for movement from a rest position to an ejecting position wherein the empty spool of the previously loaded tape is ejected through the bottom opening.

5. A device according to claim 4, wherein said means mounting a loaded paper tape for free rotational movement includes means for mounting the spool of the loaded tape for movement towards the bottom of the container as the loaded tape unwinds.

6. A device according to claim 5, wherein said lever means includes an arcuate lever pivotally mounted on the container and configured to be maintained in the rest position when a paper tape is loaded in the container and having one end portion projecting towards the bottom of the container for displacing an empty spool towards the bottom opening when the lever is moved into the ejecting position and another end portion projecting from the top opening of the container and angularly displacable about its first axis by a tape to be loaded to move the lever into the ejecting position when the tape to be loaded is inserted through the top opening.

7. A device according to claim 5, further comprising means responsive to the movement of the spool towards the bottom of the container for signalling that the spool is empty.

* * * * *